US005299960A

United States Patent [19]

Day et al.

[11] Patent Number: 5,299,960

[45] Date of Patent: Apr. 5, 1994

[54] AUXILIARY WATER PROJECTOR FOR JET PROPELLED WATERCRAFT

[76] Inventors: John B. Day, 4308 Pennington Ave.; Larry Krack, 704 S. Werner Ave., both of Evansville, Ind. 47712-4321

[21] Appl. No.: 900,824

[22] Filed: Jun. 11, 1992

[51] Int. Cl.[5] ..... B63H 11/00

[52] U.S. Cl. ..... 440/39

[58] Field of Search ..... 440/38, 39; 169/59, 169/62

[56] References Cited

U.S. PATENT DOCUMENTS 2,276,193 3/1942 Hanley .
3,139,060 6/1964 Dane ..... 440/39
3,233,573 2/1966 Hamilton ..... 440/39
3,266,733 8/1966 Goehler .
3,339,516 9/1967 Lenci ..... 440/39
3,613,630 10/1971 Jacuzzi ..... 440/39

*Primary Examiner*—Jesus D. Sotelo

[57] ABSTRACT

An auxiliary water projector system for use on jet propelled watercraft that only requires removal of the steering nozzle to be connected to the waterjet propulsion system. A thrust control valve is positioned adjacent the remounted steering nozzle. Using the thrust control valve and a flow control valve the operation of the watercraft and auxiliary water projector can be simultaneously controlled to include stationary, forward or reverse movement of the watercraft.

4 Claims, 2 Drawing Sheets

AUXILIARY WATER PROJECTOR FOR JET PROPELLED WATERCRAFT

TECHNICAL FIELD

The present invention relates generally to a water diverting piping system for use on jet propelled watercraft to divert water from jet propulsion to use for spraying, and more specifically to a piping system that can be quickly and easily mounted on personal water jet propelled craft for supplying water to be sprayed at a distance for fire fighting. The present invention can be mounted on watercraft without interfering with water jet steering nozzle mechanisms used for propulsion and steering.

BACKGROUND ART

It is known that water used for jet propulsion of watercraft can also be diverted for spraying, including for use in fire fighting. Providing diverted water spraying capability to jet propelled watercraft has involved having necessary valving and piping systems included as the craft is being built or having these systems added later after making physical modifications to the jet propelled watercraft and its propulsion system, which can be expensive and time consuming.

Providing water borne fire fighting capability is important because boat fires are among the most difficult to combat and this situation includes boat fires at marinas. Compact parking of many boats and limited water space to maneuver are common situations at marinas. Access from land to marina docked boats is generally from dock systems that include docks, ramps and floating docks that can be small and over a hundred feet long. Typically dock systems are narrow and designed for light commercial use. Bringing hose-lines over long sections of dock systems can be extremely difficult. The hose-lines tend to fall into the water or catch on power posts, rope cleats, water faucets and other dock features. Further complicating fighting marina fires is the fact that mooring lines can burn through and a burning boat can float away from the dock to include floating into other distant docked boats.

An early known example of providing a high pressure water supply for auxiliary uses on jet propelled craft is described in U.S. Pat. No. 2,276,193. Here a system for providing high pressure water on a watercraft is described as including an on board centrifugal fluid pump initially used for propulsion that also includes on board connections and on board valve controlled branches for supplying water under pressure to stand pipes. Plumbing connections for providing the high pressure lines from the centrifugal fluid pump would most conveniently be below deck to eliminate hazards from having to step over and around the centrifugal fluid pump and associated plumbing. For small craft that are not initially built with plumbing for providing auxiliary high pressure water lines there is commensurately limited space available for later installing necessary connections, piping and valving to provide auxiliary high pressure water lines that would be required for the described system.

A later example of providing high pressure water for auxiliary uses on water jet propelled craft is described in U.S. Pat. No. 3,613,630. Here again a system for providing high pressure water on a watercraft is described as including an on board jet pump that includes on board connection, piping and an on board valve system for supplying water under pressure to an auxiliary high pressure line. The jet pump with associated plumbing would again for safety and convenience need to be enclosed or below decking. Unavoidably therefore in the case of small craft not initially built with auxiliary high pressure water lines, as described here, there would be commensurately limited space available for installing necessary connections, piping and valving to provide the auxiliary high pressure water supply.

A jet propulsion apparatus for watercraft that includes an auxiliary water service pipe having an off-take connection external to the hull is described in U.S. Pat. No. 3,233,573. The auxiliary water service pipe is brought back into the hull through an aperture in the transom. Therefore, watercraft on which this system is used must originally be made with the aperture in the transom or the aperture must be cut in later before the system can be installed.

A jet propelled watercraft built for fire fighting that uses diverted water for spraying is described in U.S. Pat. No. 3,339,516. Connection to a turbine pump also used for jet propulsion along with piping and valving to provide high pressure water for fire fighting are all installed within the hull. So again connections adjacent the turbine pump and substantial portions of piping and valving must be located below decks if the crew is to be able to conveniently and safely move about the craft.

An example of modifications made to a small watercraft that include a connection for a hose is described in U.S. Pat. No. 3,139,060. Specifically, here modifications for a conventional outboard motor that can be mounted on a watercraft are described. The outboard motor is modified to simultaneously provide both waterjet propulsion and high pressure water from spray pipes that can direct streams of water mixed with chemicals for controlling growth of algae, aquatic weeds or the like. Described modifications are substantial, including installation of a centrifugal pump to the drive shaft for the outboard engine propeller. Specifically, the described modifications are identified as being intended to optimize use of a watercraft for spraying as opposed to fast jet propelled travel in combination with providing an auxiliary water supply.

DISCLOSURE OF THE INVENTION

Quick and easy modification of a personal jet propelled watercraft to install an effective auxiliary high pressure water line for fire fighting is provided by the present invention. Additionally, the auxiliary high pressure water line can be quickly and easily removed from the watercraft.

Personal jet watercraft are small light weight fast vehicles that have become exceedingly popular. They can accommodate from one to three persons depending on their size and power. Typically these personal watercraft are on the order of ten feet in length, three hundred to four hundred pounds in weight, and their engines are capable of providing from thirty to sixty horsepower. Therefore very limited space is available for modifications. Mostly these craft have been used for recreation but they are now also being used for emergency work such as rescue by fire services and rescue squads. The present invention provides for quick and effective installation of valving and piping for spraying high pressure water from such personal jet watercraft for fire fighting.

Equipment used for the present invention can include an outlet nozzle for directing sprayed water for fire fighting that is connected to a pipe having a flow control valve. The pipe can also have a pressure gauge port and a hand line port. A Y pipe section with thrust control valve is used to connect the piping system to the jet output of the watercraft propulsion system. To install the present invention on a personal jet propelled watercraft the jet steering nozzle, that is used for propelling and turning the watercraft, must be removed. This is easily done by unscrewing or unbolting the jet steering nozzle and disconnecting the mechanical system used to position the angle of the steering nozzle to control the direction the watercraft moves. With the steering nozzle removed the Y pipe section of the present invention is mounted in place of and in the same fashion as the steering nozzle. Attached to the Y pipe section is the piping and valving of the present invention. This piping and valving is conveniently laid on the deck of the personal watercraft without in any fashion having to cut the hull. A thrust control valve and the steering nozzle are now mounted on the opposite end of the Y pipe section. Finally the mechanical linkage for controlling the position of the steering nozzle is reattached to the steering nozzle. Installation of the present invention is now effectively completed without having to significantly modify the watercraft or its jet propulsion system.

With the flow control valve shut and the thrust control valve open operation of the personal watercraft is unaffected. The watercraft can be operated at high or low speeds and steered without the present invention affecting its operation. However, by opening the flow control valve and partially closing the thrust control valve, some water is redirected from propulsion through the outlet nozzle and sprayed forward of the craft. The remaining water is passed through the steering nozzle and therefor provides a force to move the craft forward. By controlling the opening of both the thrust control valve and the flow control valve the net effect of forces from the water sprayed forward of the craft and that directed aft through the steering nozzle can be selected to either maintain the craft in a stationary position or to move the craft forward or in reverse. This capability by means of opening and closing valves to determine the direction of travel and the amount of water sprayed provides an effective system for moving into position and for directing spraying of water for multiple purposes including fire fighting.

BRIEF DESCRIPTION OF THE DRAWINGS

The various objectives, advantages and novel features of the present invention will become more readily apprehended from the following detailed description when taken in conjunction with the appended drawings, in which.

BEST MODE FOR CARRYING OUT THE INVENTION

Figure 1:
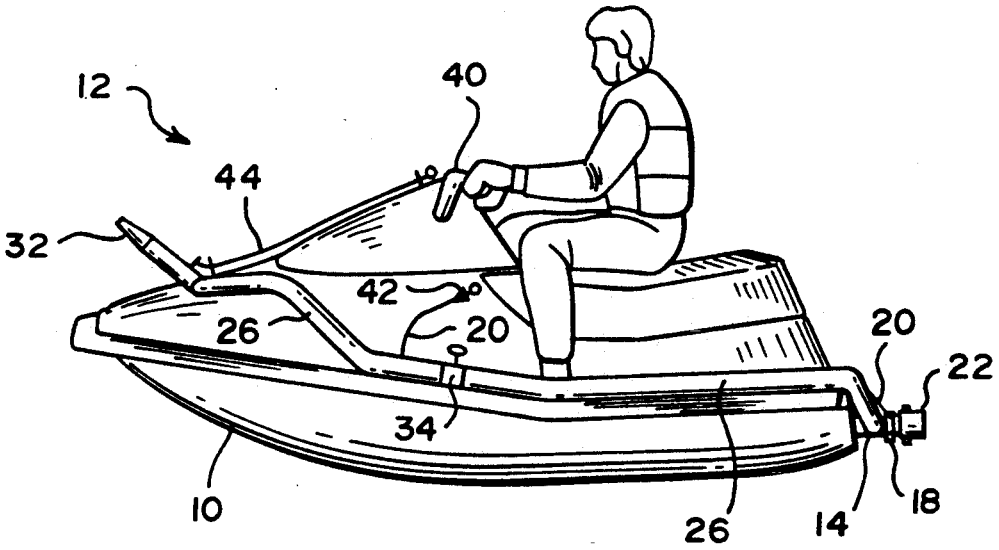
FIG. 1 is a plan side view of a personal jet watercraft with valving an piping for the present invention shown for providing auxiliary high pressure water that can be used for fire fighting and other applications.

Referring now to the drawings, wherein corresponding components are designated by the same reference numerals throughout the various FIGURES, a plan side view of a personal jet watercraft 10 with a preferred embodiment of piping and valving for the present invention is shown in FIG. 1 where the present invention is generally designated by reference numeral 12.

All parts for assembly of the apparatus 1 of the present invention are readily available plumbing supplies including piping and valving. In particular plastic plumbing supplies have been found to be useful and effective. Other types of plumbing supplies can be used as will be apparent to those skilled in the art. Further, use of the apparatus 12 of the present invention is not limited to any particular type or model of personal jet watercraft. One type of personal jet watercraft that has been used with apparatus 12 of the present invention is Yamaha WaveRunner water vehicles that are sold by Yamaha Motor Corporation, U.S.A.

Figure 2:
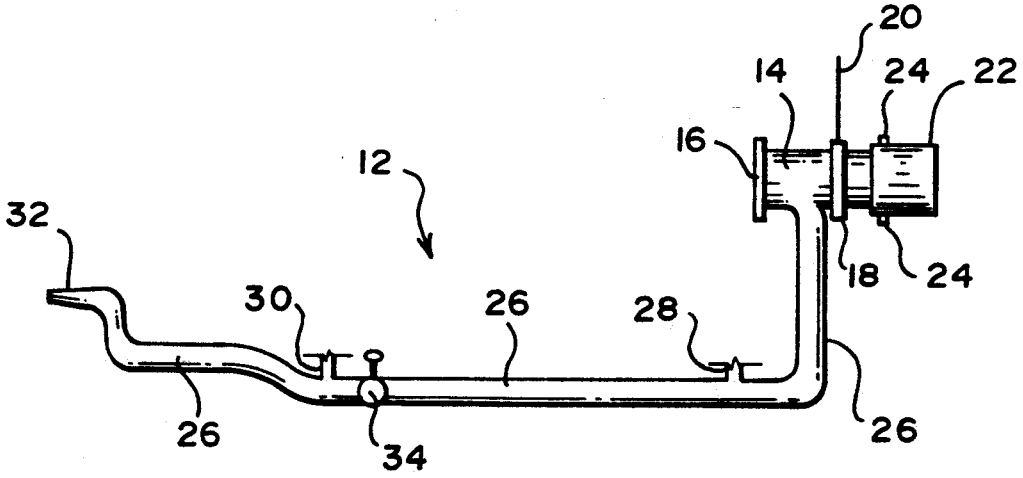
FIG. 2 is a schematic showing piping and valving for one embodiment of the present invention.
Figure 4:
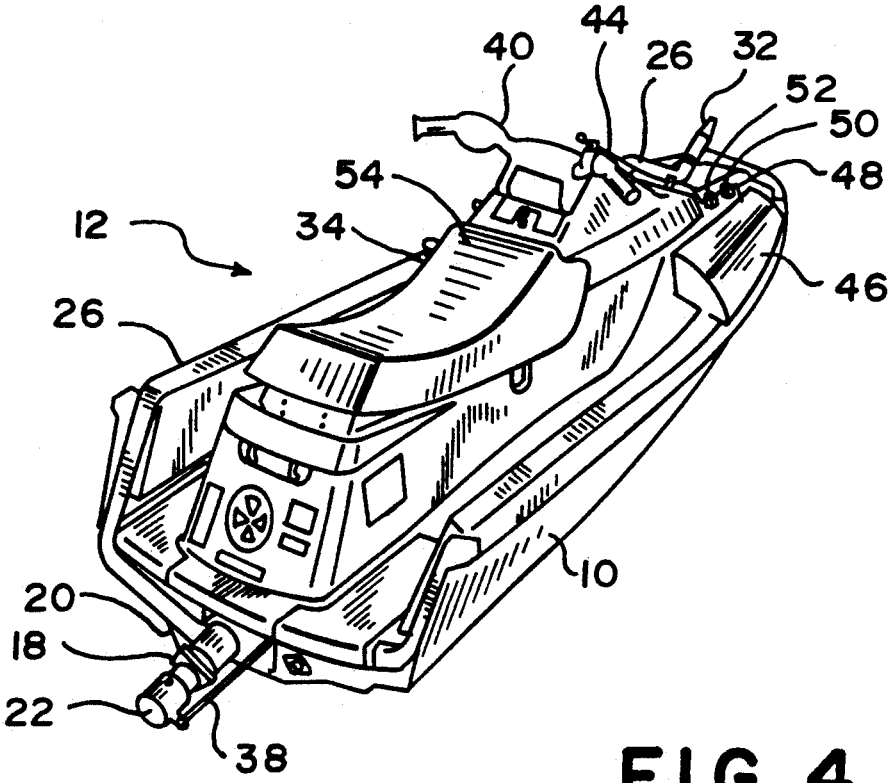
FIG. 4 is a perspective view of a personal jet watercraft from the aft showing another embodiment of the present invention.

A schematic for piping and valving for an apparatus 12 of the present invention is shown in FIG. 2. Here is shown a Y pipe section 14 as it would be attached by a mounting plate 16 to a personal jet watercraft 10. The Y pipe section 14 can in fact also be a T pipe section or any other configuration permitting diverted water flow. In direct line with water flow through the mounting plate 16 and the Y pipe section 14 is a thrust control valve 18 with a thrust control valve cable 20 that can be used for remote opening or closing of the thrust control valve 18. A knife valve, as is shown, can be used for the thrust control valve 18. When open the thrust control valve 18 permits unimpeded water flow to the steering nozzle 22 that is mounted from turning bolts 24 which allow angular positioning of the steering nozzle 22. The Y pipe section 14 can divert water flow to the apparatus pipe 26 depending on whether the thrust control valve 18 is closed. As shown in FIGS. 1 and 4 the apparatus pipe 26 is laid along the hull of the personal jet watercraft 10. As part of installation the apparatus pipe 26 can be bolted to the hull for stability.

Shown in FIG. 2 are two convenience ports from apparatus pipe 26. One is a hand line port 28 and the other is a pressure gauge port 30. These ports Can be added to the apparatus 12 of the present invention as needed depending on the application. For example it may be necessary to have a hand line port 28 for connecting a hose (not shown) that can be used to provide high pressure water in various directions quickly, which may not be as feasible using the outlet nozzle 32. The pressure gauge port 30 can be used to connect a pressure gauge (not shown) that the operator can use to determine the water pressure in the apparatus 12 of the present invention. Pressure in the apparatus 12 of the present invention is effectively controlled by the thrust control valve 18 and the flow control valve 34. Closing thrust control valve 18 and opening flow control valve 34 provides the maximum hydrodynamic pressure to the outlet nozzle 32.

Figure 3:
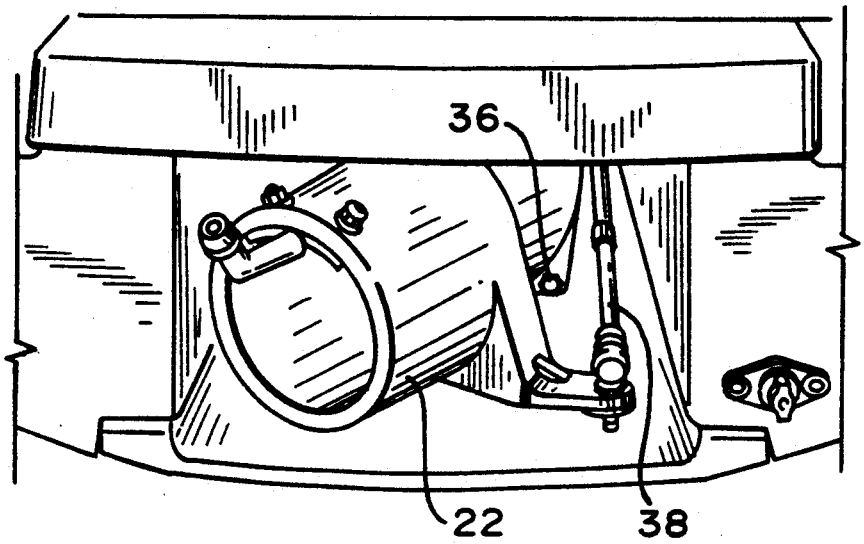
FIG. 3 is a perspective view of the aft end of a personal jet watercraft showing a steering nozzle assembly with steering cable attached to the steering nozzle before piping and valving of the present invention are attached to the watercraft.

To mount the apparatus 12 of the present invention on a personal jet watercraft 10 the mounting fasteners, such as bolts 36 (see FIG. 3), for the steering nozzle 22 assembly are removed and the steering nozzle cable 38 is disconnected from the steering nozzle 22. Now the mounting plate 16 for the Y pipe section 14 can be mounted to the personal jet watercraft 10 as previously was the steering nozzle 22 assembly. With the Y pipe section 14 and the thrust control valve 18 mounted, the steering nozzle 22 can be mounted aft of the thrust control valve 18 by using turning bolts 24 that permit the steering nozzle to angular turn about the axis defined by turning bolts 24. Finally using a cable extension section (not shown), if necessary, the steering nozzle cable 38 can be remounted to the steering nozzle 22 to permit mechanical control, via the handlebar 40, of the angular position of the steering nozzle 22.

As explained earlier the apparatus pipe 26 with outlet nozzle 32 can be laid on the hull of the personal jet watercraft 10. For convenience, if desired, the end of the thrust control valve cable 20 can be fastened to the hull of personal jet watercraft 10 using a mounting plate 42. The operator can then easily adjust the opening of the thrust control valve 18. Additionally, for convenience, an outlet nozzle cable 44 can be attached to the outlet nozzle 32 for repositioning the angle that water is sprayed from the personal jet watercraft 10.

Another embodiment of the present invention is shown in FIG. 4. Here a tank 46 for containing additive foam chemicals is mounted on the hull of the personal jet watercraft 10, and a pipe line 48 is connected to a pump 50 to pump chemicals out of the tank 46. The pump 50 can be known type for providing, for example, 50 pounds per square inch pressure. The pump 50 can be operable from 12 volt electrical system as is normally available on personal jet watercraft. The tank 46 can be of about 8 gallon capacity for most practical applications. In addition to mounting the tank 46 on the hull 10 the tank 46 can also be conveniently stored under the seat 54. On many personal jet watercraft there is sufficient space available for mounting the tank 46. For example, many personal jet watercraft have an ice cooler under the set 54 that can be removed to provide room for tank 46. Down stream from the pump 50 is a proportioning valve 52 for adjusting chemical flow. Finally there is a foam inlet to apparatus pipe 26, as is known for injecting foam chemicals into a high pressure water line. Typically the proportioning valve 52 is adjustable to permit 0.2 to 6.0 percent chemical flow, which are useful proportions for fire fighting foams.

The above discussion and related illustrations of the present invention are directed primarily to a preferred embodiment and practices of the invention. However, it is believed that numerous changes and modifications in the actual implementation of the concepts described herein will be apparent to those skilled in the art, and it is contemplated that such changes and modifications may be made without departing from the scope of the invention as defined by the following claims.

What is claimed is:

1. An auxiliary water projector for watercraft having at least one waterjet propulsion system, said auxiliary water projection comprising:

a Y pipe means having a first mounting means for mounting said Y pipe means to said waterjet propulsion system so water flows from said waterjet propulsion system into said Y pipe means before entering any steering nozzle means;

a thrust control valve means mounted at a first outlet of said Y pipe means to permit or stop water flow through said outlet;

a pipe connected to a second outlet of said Y pipe means, said pipe having an outlet means; and, a hand line outlet means connected to said pipe.

2. An auxiliary water projector for watercraft having at least one waterjet propulsion system, said auxiliary water projector comprising:

a Y pipe means having a first mounting means for mounting said Y pipe means to said waterjet propulsion system so water flows from said waterjet propulsion system into said Y pipe means before entering any steering nozzle means;

a thrust control valve means mounted at a first outlet of said Y pipe means to permit or stop water flow through said first outlet;

a pipe connected to a second outlet of said Y pipe means, said pipe having an outlet means;

a tank means for containing chemicals to be injected into water flowing through said pipe;

a pump means for forcing said chemicals into said pipe from said tank means; and, a proportioning valve means for controlling the amount of said chemicals forced into said pipe.

3. An auxiliary water projector for watercraft having at least one waterjet propulsion system, said auxiliary water projector comprising;

a Y pipe means having a first mounting means for mounting said Y pipe means to said waterjet propulsion system so water flows from said waterjet propulsion system into said Y pipe means before entering any steering nozzle means;

a thrust control valve means mounted at a first outlet of said Y pipe means to permit or stop water flow through said first outlet;

a pipe connected to a second outlet of said Y pipe means, said pipe having an outlet means; and, a cable means for controlling the position of said outlet means.

4. A method for providing an auxiliary water projector for watercraft having at least one waterjet propulsion system including the steps of:

dismounting at least one steering nozzle means from said watercraft;

mounting a Y pipe means to said watercraft so water flows from said waterjet propulsion system into said Y pipe means;

mounting said steering nozzle means adjacent a thrust control valve means that controls the flow of water from a first outlet of said Y pipe means;

using a pipe connected to a second outlet of said Y pipe means to provide water to an outlet means from said pipe; and, using a cable means for positioning said outlet means.

* * * * *